United States Patent [19]

Colgan

[11] 3,931,777

[45] Jan. 13, 1976

[54] AQUA SLED

[75] Inventor: William B. Colgan, Shalimar, Fla.

[73] Assignee: The Raymond Lee Organization, Inc., New York, N.Y. ; a part interest

[22] Filed: Mar. 12, 1975

[21] Appl. No.: 557,508

[52] U.S. Cl. ..... 114/16 A; 9/310 B

[51] Int. Cl.[2] ..... A63C 15/00

[58] Field of Search..... 9/310 R, 310 B, 310 E, 9/310 F, 310 H, 310 J; 114/16 A, 16 F; 272/13; 115/6, 6.1, 70; D12/6, 11

[56] References Cited

UNITED STATES PATENTS

| | | | |
|---|---|---|---|
| 2,843,860 | 7/1958 | Grootveld | 114/16 A |
| 2,936,466 | 5/1960 | Szymczyk et al. | 9/310 B |
| 3,255,723 | 6/1966 | Tector | 114/16 A |

FOREIGN PATENTS OR APPLICATIONS

| | | | |
|---|---|---|---|
| 2,050,890 | 4/1972 | Germany | 9/310 B |

*Primary Examiner*—George E. A. Halvosa
*Assistant Examiner*—Jesus D. Sotelo
*Attorney, Agent, or Firm*—Daniel Jay Tick

[57] ABSTRACT

An aqua sled for carrying people on and under water comprises a frame of aluminum tubing having a rigid planar section of transparent material to enable users to see beneath the sled and buoyant material affixed thereto to float the sled. A pair of sheets of rigid transparent material are affixed to the front of the frame and form a dihedral of approximately 90° with each other. Each of the sheets extends at an angle of approximately 45° with a corresponding side of the planar section of transparent material. A control device is affixed to the frame and is manually controllable to control the movement of the sled.

3 Claims, 2 Drawing Figures

AQUA SLED

DESCRIPTION OF THE INVENTION

The present invention relates to an aqua sled. More particularly, the invention relates to an aqua sled for carrying people on and under water.

Objects of the invention are to provide an aqua sled of simple structure, which is inexpensive in manufacture, operated by anyone, skilled or unskilled, and functions efficiently, effectively and reliably on the surface of a body of water and under water.

Figure 1:
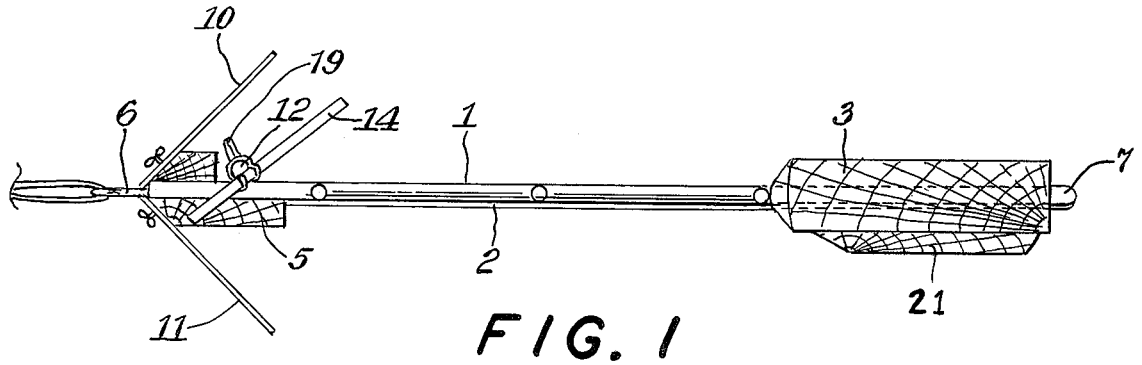
Figure 2:
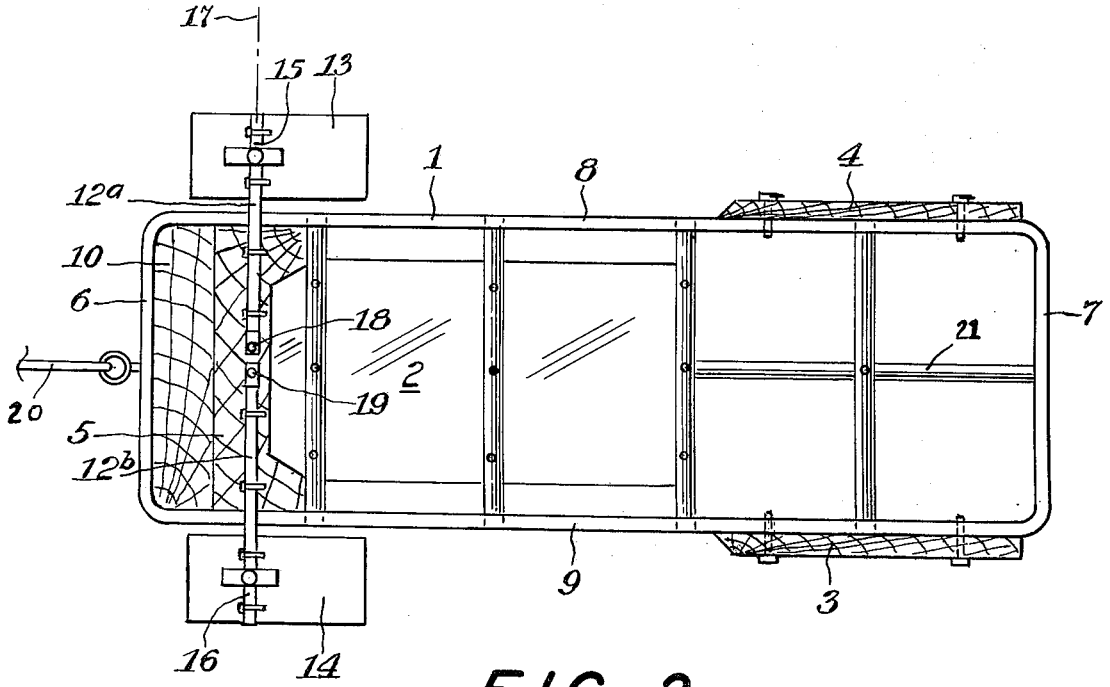

In order that the invention may be readily carried into effect, it will now be described with reference to the accompanying drawing, wherein:

FIG. 1 is a side view of an embodiment of the aqua sled of the invention; and FIG. 2 is a top plan view of FIG. 1.

In the FIGS., the same components are identified by the same reference numerals.

The aqua sled of the invention carries people on and under water and comprises a frame 1 of aluminum tubing has a substantially rigid substantially planar section of transparent material 2 to enable users to see beneath the sled. Buoyant material 3, 4 and 5 of any suitable type such as, for example, plastic foam, wood, or the like, is affixed to the frame 1 to float the sled. The frame 1 has a front 6, a back 7 and sides 8 and 9.

A pair of sheets 10 and 11 of substantially rigid transparent material such as, for example, clear plastic, are affixed to the front of the frame and form a dihedral of approximately 90° with each other. Each of the sheets 10 and 11 extends at an angle of approximately 45° with a corresponding side of the planar section of transparent material 2.

A control device is affixed to the frame 1 and is manually controllable to control the movement of the sled. The control device comprises a pair of independently rotatable rod-like members 12*a* and 12*b* affixed to the frame 1 and extending beyond both sides 8 and 9 of the frame. Each of a pair of plate-like members 13 and 14 is movably mounted on a corresponding outboard end 15 and 16, respectively, of the members 12*a* and 12*b*, respectively. The plate-like members 13 and 14 are positioned in spaced relation with the frame 1 for free rotation about the axis 17 of the rod-like members 12*a* and 12*b*.

Handles 18 and 19 are provided on the inboard ends of the rod-like members 12*a* and 12*b*, respectively, of the control device for facilitating manual rotation of the members 13 and 14 to control the depth, pitch and roll of the sled.

The control handles 18 and 19 are rectangular in shape at their tops and are close enough to grasp with one hand. The handles are moved fore and aft for pitch or elevation and diving or surfacing and are twisted for rolling and/or turning. The handles 18 and 19 are removably affixed to the rod-like members 12*a* and 12*b*, respectively, for easy removal in transporting the sled.

The buoyant material makes it easy to board and use the sled of the invention and provide operational safety. The control of the sled is stable, simple and easy, due to the waterscreen and control arrangements. The waterscreens and controls are installable and removable with facility, convenience and rapidity for ease and convenience in transporting the sled and for reducing chances of damage. There is no need for attaching straps for the user or operator. The sled is very simple, manufactured very inexpensively, and easy to use. The sled provides fun, recreation and has many other functions, uses and advantages.

All the material above and below the frame is of flotation type and may be of one or two piece construction. There is sufficient space provided between the control handles 18 and 19 and the top flotation and waterscreen mounting material for the operator's hands at full down deflection of the controls.

A tow line 20 is swivelly affixed to the front of the sled to permit rolling of the sled. A skeg 21 is included.

While the invention has been described by means of a specific example and in a specific embodiment, I do not wish to be limited thereto, for obvious modifications will occur to those skilled in the art without departing from the spirit and scope of the invention.

I claim:

1. An aqua sled for carrying people on and under water, comprising a frame of aluminum tubing having a substantially rigid substantially planar section of transparent material to enable users to see beneath the sled and buoyant material affixed thereto to float the sled, the frame having a front, a back and sides;

a pair of sheets of substantially rigid transparent material affixed to the front of the frame and forming a dihedral of approximately 90° with each other, each extending at an angle of approximately 45° with a corresponding side of the planar section of transparent material; and control means affixed to the frame and manually controllable to control the movement of the sled.

2. An aqua sled as claimed in claim 1, wherein the control means comprises a rod-like member affixed to the frame and extending beyond both sides of the frame and a pair of plate-like members each movably mounted on a corresponding end of the rod-like member in spaced relation with the frame for free rotation about the axis of the rod-like member.

3. An aqua sled as claimed in claim 2, further comprising handle means on the plate-like members of the control means for facilitating manual rotation of the plate-like members to control the depth, pitch and roll of the sled.

* * * * *